US007901182B2

(12) United States Patent
Liang

(10) Patent No.: US 7,901,182 B2
(45) Date of Patent: Mar. 8, 2011

(54) NEAR WALL COOLING FOR A HIGHLY TAPERED TURBINE BLADE

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 1127 days.

(21) Appl. No.: 11/804,434

(22) Filed: May 18, 2007

(65) Prior Publication Data

US 2008/0286104 A1 Nov. 20, 2008

(51) Int. Cl.
*F01D 5/18* (2006.01)

(52) U.S. Cl. ..... 416/97 R

(58) Field of Classification Search ..... 415/115; 416/96 R, 97 R, 97 A
See application file for complete search history.

(56) References Cited

U.S. PATENT DOCUMENTS 3,014,693 A * 12/1961 Horne ..... 416/92
4,500,258 A * 2/1985 Dodd et al. ..... 416/97 R
5,993,155 A 11/1999 Endres et al.
5,993,156 A * 11/1999 Bailly et al. ..... 416/96 A
6,478,535 B1 11/2002 Chung et al.
6,910,864 B2 6/2005 Tomberg
6,955,523 B2 10/2005 McClelland
6,957,949 B2 * 10/2005 Hyde et al. ..... 416/97 R
2005/0025623 A1 * 2/2005 Botrel et al. ..... 416/97 R

* cited by examiner

*Primary Examiner* — Edward Look
*Assistant Examiner* — Jesse Prager

(57) ABSTRACT

A turbine blade having a pressure sidewall and a suction sidewall connected at chordally spaced leading and trailing edges to define a cooling cavity. Pressure and suction side inner walls extend radially within the cooling cavity and define pressure and suction side near wall chambers. A plurality of mid-chord channels extend radially from a radially intermediate location on the blade to a tip passage at the blade tip for connecting the pressure side and suction side near wall chambers in fluid communication with the tip passage. In addition, radially extending leading edge and trailing edge flow channels are located adjacent to the leading and trailing edges, respectively, and cooling fluid flows in a triple-pass serpentine path as it flows through the leading edge flow channel, the near wall chambers and the trailing edge flow channel.

16 Claims, 7 Drawing Sheets

NEAR WALL COOLING FOR A HIGHLY TAPERED TURBINE BLADE

This invention was made with U.S. Government support under Contract Number DE-FC26-05NT42644 awarded by the U.S. Department of Energy. The U.S. Government has certain rights to this invention.

FIELD OF THE INVENTION

This invention is directed generally to an airfoil for a gas turbine engine and, more particularly, to a turbine blade airfoil having cooling cavities for conducting a cooling fluid to provide near wall cooling in a highly tapered turbine blade.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products defining a working gas. The working gas is supplied to the turbine where the gas passes through a plurality of paired rows of stationary vanes and rotating blades. The rotating blades are coupled to a shaft and disc assembly. As the working gas expands through the turbine, the working gas causes the blades, and therefore the shaft and disc assembly, to rotate.

Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades comprise a root, a platform and an airfoil that extends outwardly from the platform. The airfoil is ordinarily composed of a tip, a leading edge and a trailing edge. Most blades typically contain internal cooling channels forming a cooling system. The cooling channels in the blades may receive air from the compressor of the turbine engine and pass the air through the blade. The cooling channels often include multiple flow paths that are designed to maintain the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

A conventional cooling system in a turbine blade assembly may include an intricate maze of cooling flow paths through various portions of the turbine blade.

Further, third row turbine blades, which may comprise a highly tapered large airfoil, present additional cooling problems associated with the geometry of the airfoil. Specifically, the lower or radially inward portion of the airfoil comprises a large cross section area, and the cross section tapers to a smaller thickness toward the tip of the blade. Accordingly, the configuration of the cooling circuit requires particular consideration to providing an airflow in contact with the lower portions of the airfoil to maintain the heat transfer coefficient in the wider cross section portion of the blade.

While many of the known cooling systems for turbine blades have operated successfully, a need still exists to provide increased cooling capability, particularly in turbine blades having highly tapered large airfoils.

SUMMARY OF THE INVENTION

In accordance with one aspect of the invention, a turbine blade is provided comprising an outer wall extending from a blade root to a blade tip. The outer wall comprises a pressure sidewall and a suction sidewall, and the pressure and suction sidewalls are connected at chordally spaced leading and trailing edges. A cooling cavity is defined between the pressure and suction sidewalls. A pressure side inner wall extends radially within the cooling cavity from a location adjacent the blade root toward the blade tip and defines a pressure side near wall chamber. A suction side inner wall extends radially within the cooling cavity from a location adjacent the blade root toward the blade tip and defines a suction side near wall chamber. The suction side inner wall intersects the pressure side inner wall at an intermediate location between the blade root and the blade tip. A plurality of pressure side channels extend radially from the intermediate location to a tip passage at the blade tip for connecting the pressure side near wall chamber in fluid communication with the tip passage, and a plurality of suction side channels extend radially from the intermediate location to the blade tip for connecting the suction side near wall chamber in fluid communication with the tip passage.

In accordance with another aspect of the invention, a turbine blade is provided comprising an outer wall extending from a blade root to a blade tip. The outer wall comprises a pressure sidewall and a suction sidewall, and the pressure and suction sidewalls are connected at chordally spaced leading and trailing edges. A cooling cavity is defined between the pressure and suction sidewalls. A pressure side inner wall extends radially within the cooling cavity from a location adjacent the blade root toward the blade tip and defines a pressure side near wall chamber. A suction side inner wall extends radially within the cooling cavity from a location adjacent the blade root toward the blade tip and defines a suction side near wall chamber. A leading edge flow channel extends radially adjacent to the leading edge, and a trailing edge flow channel extends radially adjacent to the trailing edge. A cooling fluid supply provides cooling fluid to at least the leading edge flow channel, and the cooling fluid flows in at least a triple-pass serpentine path through the leading edge flow channel, the pressure side near wall chamber, the suction side near wall chamber and the trailing edge flow channel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
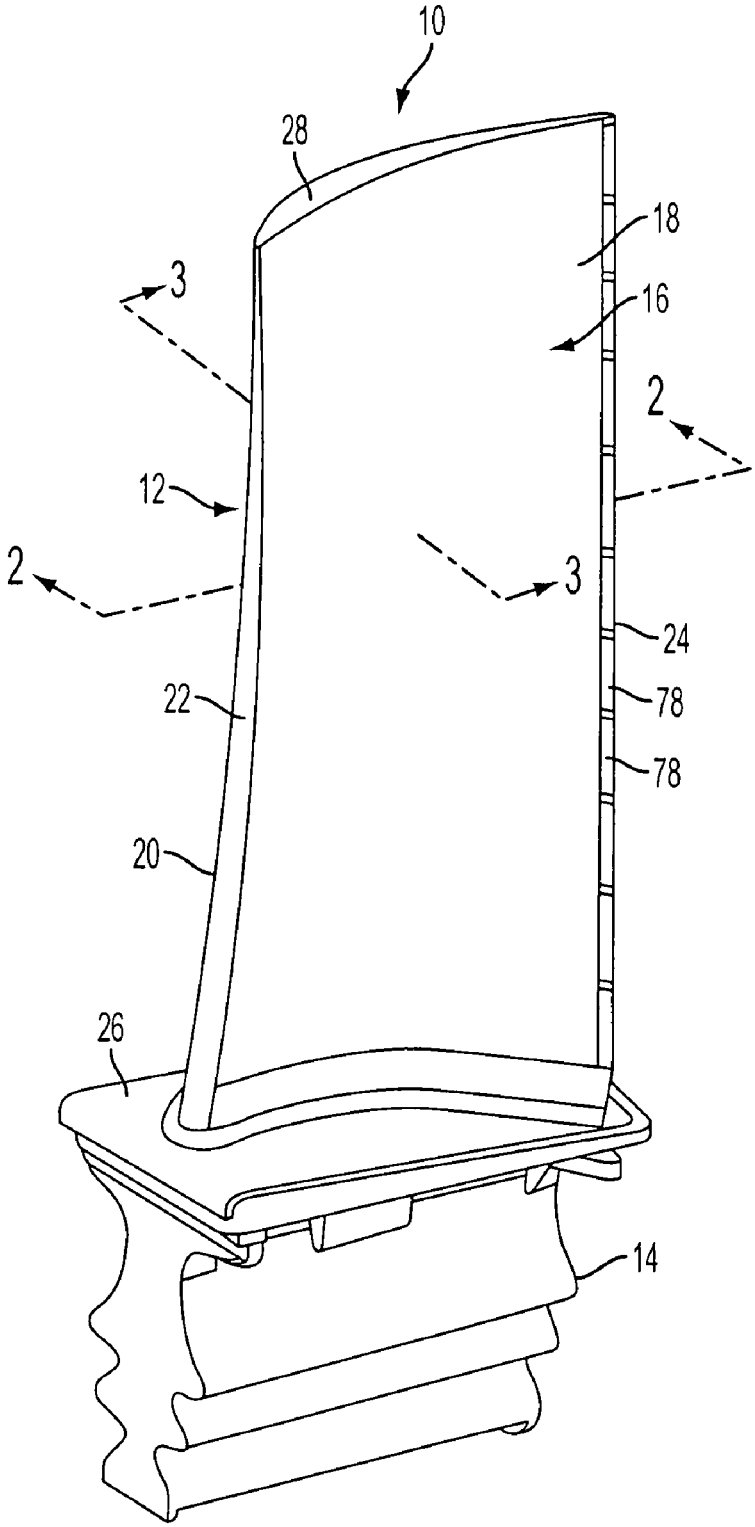
FIG. 1 is a perspective view of a turbine blade incorporating the present invention.

Referring now to FIG. 1, a turbine blade 10 constructed in accordance with the present invention is illustrated. The blade 10 is adapted to be used in a gas turbine (not shown) of a gas turbine engine (not shown). The gas turbine engine includes a compressor (not shown), a combustor (not shown), and a turbine (not shown). The compressor compresses ambient air. The combustor combines compressed air with a fuel and ignites the mixture creating combustion products defining a high temperature working gas. The high temperature working gas travels to the turbine. Within the turbine are a series of rows of stationary vanes and rotating blades. Each pair of rows of vanes and blades is called a stage. Typically, there are four stages in a turbine. It is contemplated that the blade 10 described herein may define blade configuration for a third stage of blades in the gas turbine.

The stationary vanes and rotating blades are exposed to the high temperature working gas. To cool the vanes and blades, cooling air from the compressor is provided to the vanes and the blades.

The blade 10 includes an airfoil 12 and a blade root 14 which is used to conventionally secure the blade 10 to a rotor disk of the engine for supporting the blade 10 in the working medium flow path of the turbine where working medium gases exert motive forces on the surfaces thereof. The airfoil 12 has an outer wall 16 comprising a generally concave pressure sidewall 18 and a generally convex suction sidewall 20. The pressure and suction sidewalls 18, 20 are joined together along an upstream leading edge 22 and a downstream trailing edge 24. The leading and trailing edges 22, 24 are spaced axially or chordally from each other. The airfoil 12 extends radially along a longitudinal or radial direction of the blade 10, defined by a span of the airfoil 12, from a radially inner airfoil platform 26 to a radially outer blade tip 28.

Figure 2A:
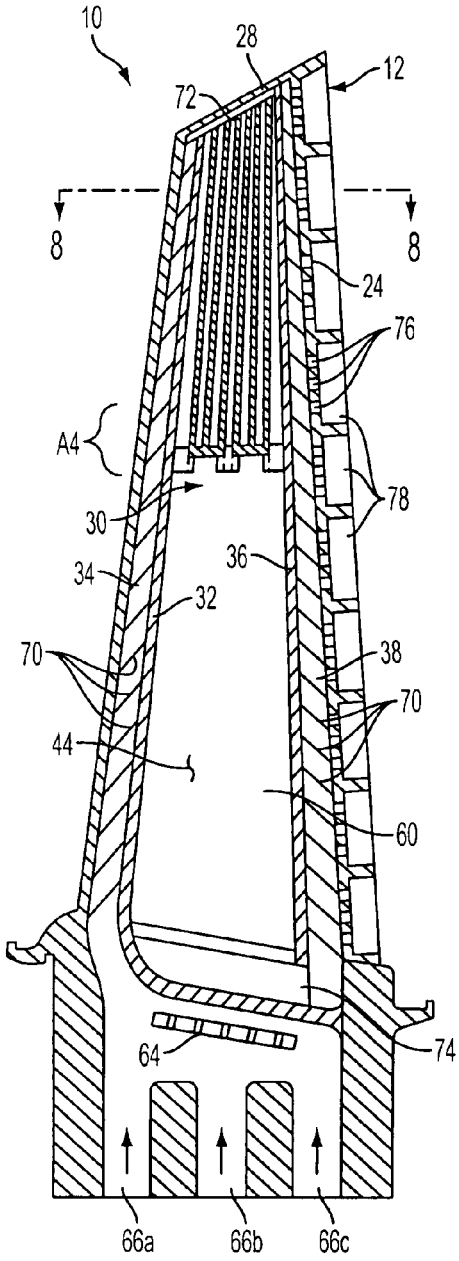
FIG. 2A is a cross-sectional view of the turbine blade shown in FIG. 1 taken along line 2-2.
Figure 2B:
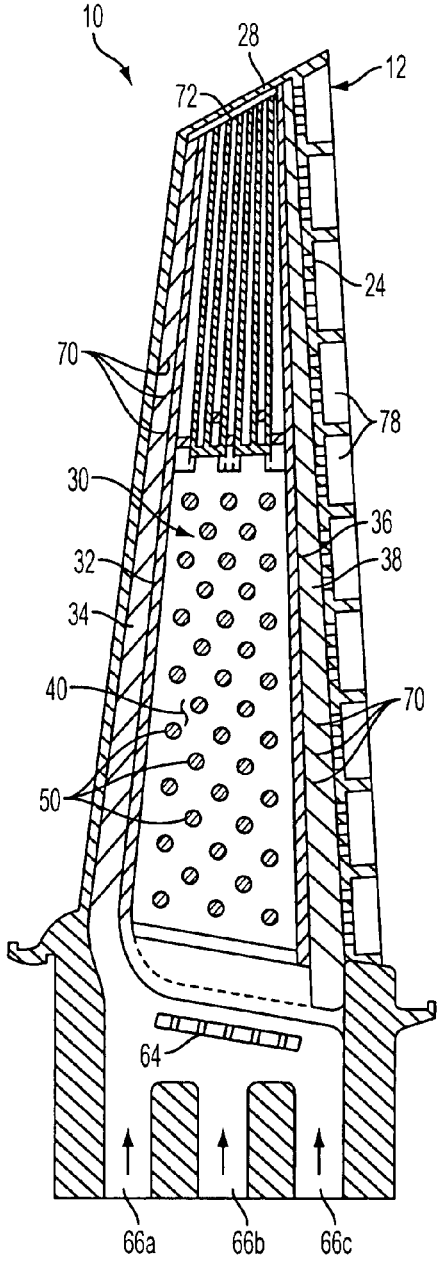
FIG. 2B is a sectional view of the turbine blade shown in FIG. 1 with the pressure sidewall cut away.

Referring to FIGS. 2A and 2B, the airfoil 12 defines a radially extending cooling cavity 30 located between the pressure sidewall 18 and the suction sidewall 20 and extending between the blade root 14 and the blade tip 28. A leading edge partition 32 extends radially through the cooling cavity 30 adjacent to the leading edge 22. The leading edge partition 32 extends between the pressure and suction sidewalls 18, 20 to define a leading edge flow channel 34. A trailing edge partition 36 extends radially through the cooling cavity 30 adjacent to the trailing edge 24. The trailing edge partition 36 extends between the pressure and suction sidewalls 18, 20 to define a trailing edge flow channel 38.

Figure 3:
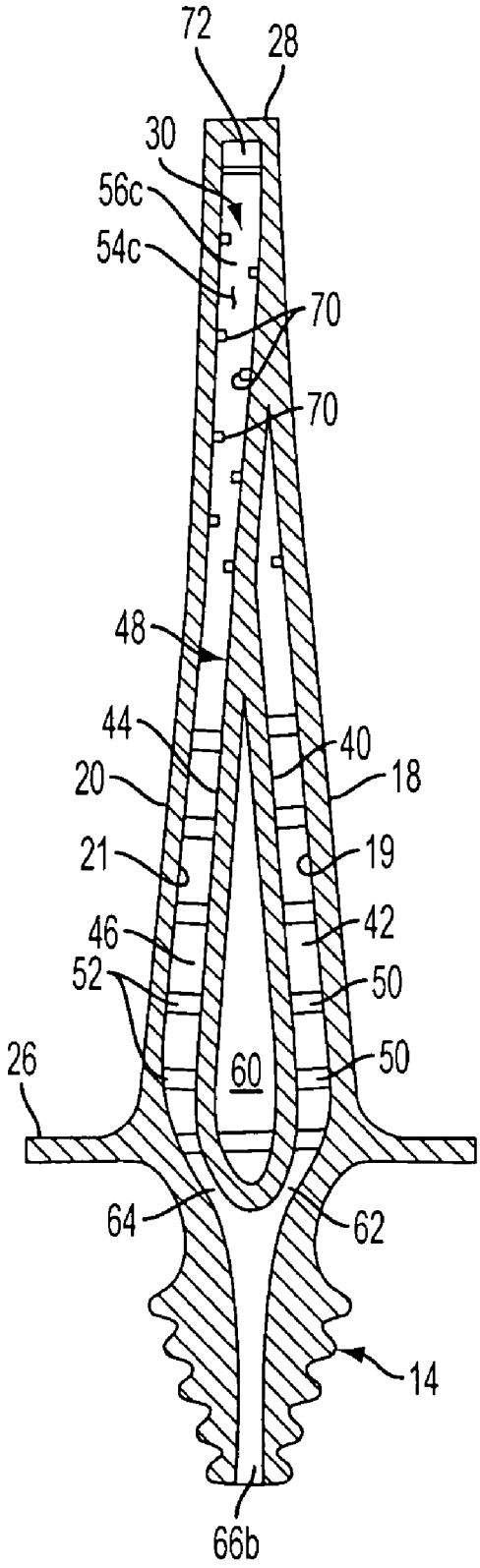
FIG. 3 is a cross-sectional view of the turbine blade shown in FIG. 1 taken along line 3-3.
Figure 4:
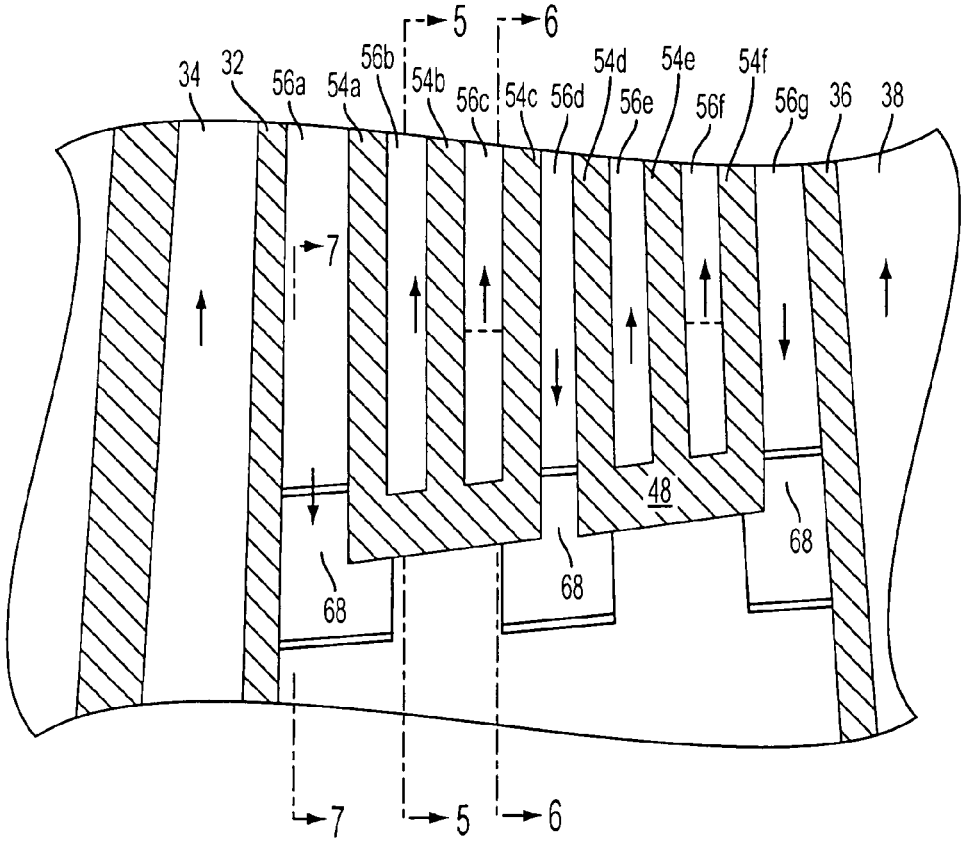
FIG. 4 is an enlarged view of the area of FIG. 2A identified by bracket A4.
Figure 8:
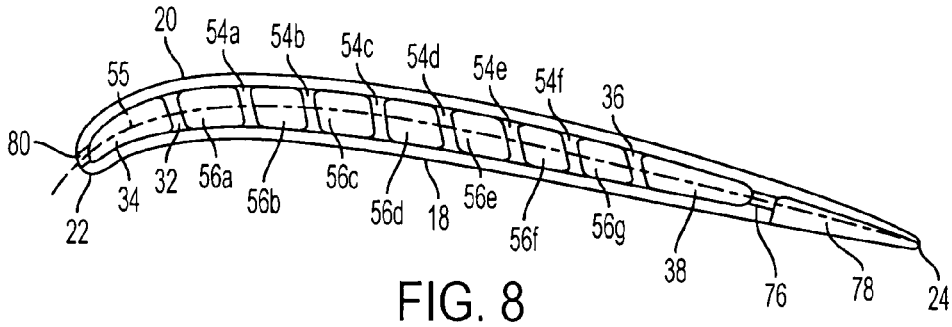
FIG. 8 is a cross-sectional view of the turbine blade airfoil taken at the location indicated by line 8-8 in FIG. 2A.

Referring to FIG. 3, a pressure side inner wall 40 extends radially within the cooling cavity 30 from a location adjacent the blade root 14 toward the blade tip 28. The pressure side inner wall 40 extends from the leading edge partition 32 to the trailing edge partition 36 and is located in spaced relation to the interior surface 19 of the pressure sidewall 18 to define a pressure side near wall chamber 42. A suction side inner wall 44 extends radially within the cooling cavity 30 from a location adjacent the blade root 14 toward the blade tip 28. The suction side inner wall 44 extends from the leading edge partition 32 to the trailing edge partition 36 and is located in spaced relation to the interior surface 21 of the suction sidewall 20 to define a suction side near wall chamber 46. The pressure side inner wall 40 and suction side inner wall 44 extend in converging relation toward each other and intersect at an intermediate location 48 intermediate the blade root 14 and the blade tip 28.

The pressure side near wall chamber 42 may include a plurality of pin fins 50 to provide extended convection cooling surfaces and to increase the stiffness of the pressure sidewall 18. Similarly, the suction side near wall chamber 46 may include a plurality of pin fins 52 for extending the convection cooling surfaces in the pressure side near wall chamber 46 and to increase the stiffness of the suction sidewall 20. In addition, the pin fins 50, 52 increase the conduction of heat from the pressure and suction sidewalls 18, 20 to the respective pressure and suction side inner walls 40, 44.

Referring to FIGS. 2A, 2B, 4 and 8, the upper or radially outer portion of the airfoil 12, between the intermediate location 48 and the blade tip 28, includes a plurality of chordally spaced mid-chord partitions 54*a*, 54*b*, 54*c*, 54*d*, 54*e*, 54*f* (FIGS. 4 and 8) extending between the pressure sidewall 18 and the suction sidewall 20. The mid-chord partitions 54*a*, 54*b*, 54*c*, 54*d*, 54*e*, 54*f* define a plurality of radially extending chordally spaced mid-chord channels 56*a*, 56*b*, 56*c*, 56*d*, 56*e*, 56*f*, 56*g* generally positioned along a chordal centerline 55 (FIG. 8) of the airfoil 12, i.e., located generally centrally between the pressure sidewall 18 and the suction sidewall 20. The mid-chord channels 56*b* and 56*e* extend radially from the pressure side near wall chamber 42 to define pressure side channels, and the mid-chord channels 56*c* and 56*f* extend radially from the suction side chamber 46 to define suction side channels. In addition, the mid-chord channels 56*a*, 56*d* and 56*g* define return channels that extend radially past the intermediate location 48 to connect a tip passage 72, extending chordally between the blade tip 28 and the upper edges of the mid-chord partitions 54*a*, 54*b*, 54*c*, 54*d*, 54*e*, 54*f* and the leading edge partition 32, to a collection cavity 60 (FIG. 3) located between the pressure side inner wall 40 and the suction side inner wall 44.

Figure 5:
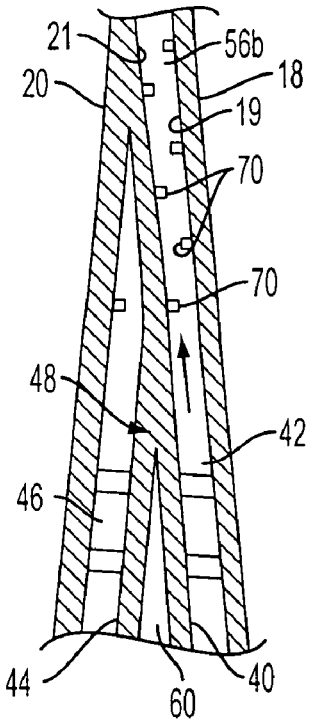
FIG. 5 is a cross-sectional view of the turbine blade shown in FIG. 4 taken along line 5-5.
Figure 6:
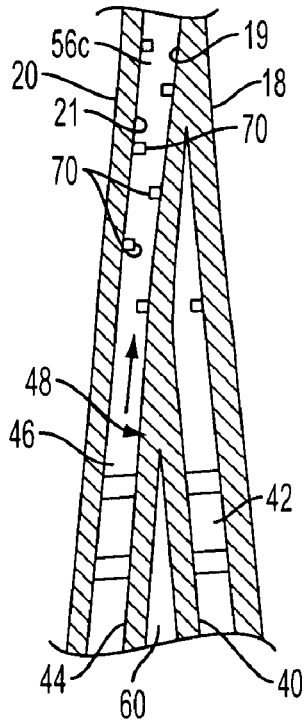
FIG. 6 is a cross-sectional view of the turbine blade shown in FIG. 4 taken along line 6-6.
Figure 7:
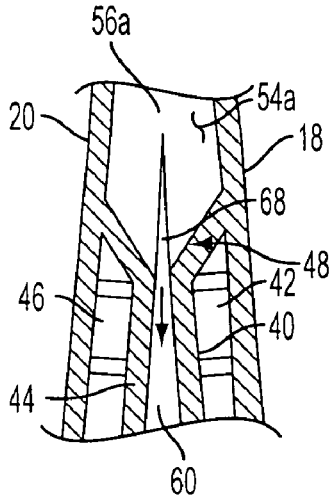
FIG. 7 is a cross-sectional view of the turbine blade shown in FIG. 4 taken along line 7-7.

Referring to FIG. 5, in which the pressure side channel 56*b* is typical of both pressure side channels 56*b*, 56*e*, it can be seen that the pressure side inner wall 40 extends to the suction sidewall 20 such that the inner wall 40 is continuous with the inner surface 21 of the suction sidewall 20. Referring to FIG. 6, in which the suction side channel 56*c* is typical of both suction side channels 56*c*, 56*f*, it can be seen that the suction side inner wall 44 extends to the pressure sidewall 18 such that the inner wall 44 is continuous with the inner surface 19 of the pressure sidewall 18. In addition, as seen in FIG. 7, in which the return channel 56*a* is typical of the return channels

56*a*, 56*d* and 56*g*, a return passage 68 is defined between the return channel 56*a* and the collection cavity 60 to permit flow of spent cooling fluid from the return passage 56*a* into the collection cavity 60. It should also be noted that the interior surfaces 19, 21 of pressure sidewall 18 and the suction sidewall 20 as well as surfaces of the inner walls 40, 44 may be provided with trip strips 70 to facilitate heat transfer at the boundary layer between the cooling fluid and the interior surfaces of the airfoil 12. Trip strips 70 may additionally be provided along the interior surfaces of the leading edge flow channel 34 and trailing edge flow channel 38 (FIGS. 2A and 2B).

Referring to FIGS. 2A, 2B and 3, the pressure side near wall chamber 42 and suction side near wall chamber 46 are connected to cooling fluid supply openings 66*a*, 66*b*, 66*c* in the blade root 14 via respective conduits 62, 64. Cooling fluid, such as cooling air supplied from the compressor for the gas turbine engine, flows from the conduits 62, 64 into the respective near wall chambers 42, 46 where heat is transferred to the cooling fluid from the lower half of the pressure sidewall 18 and suction sidewall 20 of the airfoil 12. The cooling fluid further flows radially outwardly through the pressure side channels 56*b*, 56*e* and through the suction side channels 56*c*, 56*f* to the tip passage 72 extending chordally adjacent to the blade tip 28. In addition, cooling fluid flows through the leading edge flow channel 34 to the tip passage 72.

The spent cooling fluid flows radially inwardly through the return channels 56*a*, 56*d* and 56*g* and is collected in the collection cavity 60. The spent cooling fluid further flows out of the collection cavity 60 though a trailing edge passage 74 (FIG. 2A) and into the trailing edge flow channel 38 where the fluid flows radially outwardly. The trailing edge 24 includes exit holes 76 and trailing edge slots 78 for providing a film of cooling fluid to the trailing edge 24. Further, the leading edge 22 may be providing with exit holes 80 (FIG. 8) extending from the leading edge flow channel 34 to provide a film of cooling fluid at the leading edge 22.

The above described structure effectively provides a triple-pass serpentine path for the cooling fluid where the cooling fluid initially flows radially outwardly to the tip passage 72, flows radially inwardly into the collection cavity 60 and then flows radially outwardly through the trailing edge flow channel 38. Flow of the cooling fluid into the collection cavity 60 places the cooling fluid in contact with the interior surfaces of the inner walls 40, 44, permitting the spent or warmed cooling fluid to transfer heat to the inner walls 40, 44 and thereby reduce the temperature differential between the inner walls 40, 44 and the pressure and suction sidewalls 18, 20. In addition, the pin fins 50, 52 may conduct heat inwardly to the inner walls 40, 44 to reduce the thermal gradient.

The size and distribution or spacing of the pin fins 50, 52 may be selected based on the airfoil external heat load. Also, the heat transfer performance of the near wall chambers 42, 46 may be controlled by forming the near wall chambers 42, 46 as tapered convective channels to control the flow velocity in relation to the desired heat transfer. Further, it should be noted that the pressure and suction side channels 56*b*, 56*c*, 56*e*, 56*f* provide a reduced flow area, operating to accelerate the flow velocity of the cooling fluid it leaves the near wall chambers 42, 46 and thereby generates an increased heat transfer coefficient to maintain the cooling efficiency as the cooling fluid flows through the radially outer portion of the airfoil 12.

Referring to FIGS. 9-12 and alternative configuration for the turbine blade of the present invention is disclosed where elements corresponding to elements of the first described configuration are labeled with the same reference numeral increased by 100.

As in the first described configuration, the turbine blade 110 includes an airfoil with a pressure side inner wall 140 located adjacent a pressure sidewall 118 and a suction side inner wall 144 located adjacent a suction sidewall 120 to define near wall chambers 142 and 146, respectively, at the radially inner portion of the airfoil 112. In addition, flow channels 156*a*-156*g* are provided extending to a tip passage 172 from an intermediate location 148 at the outer end of the inner walls 140, 144.

Figure 9:
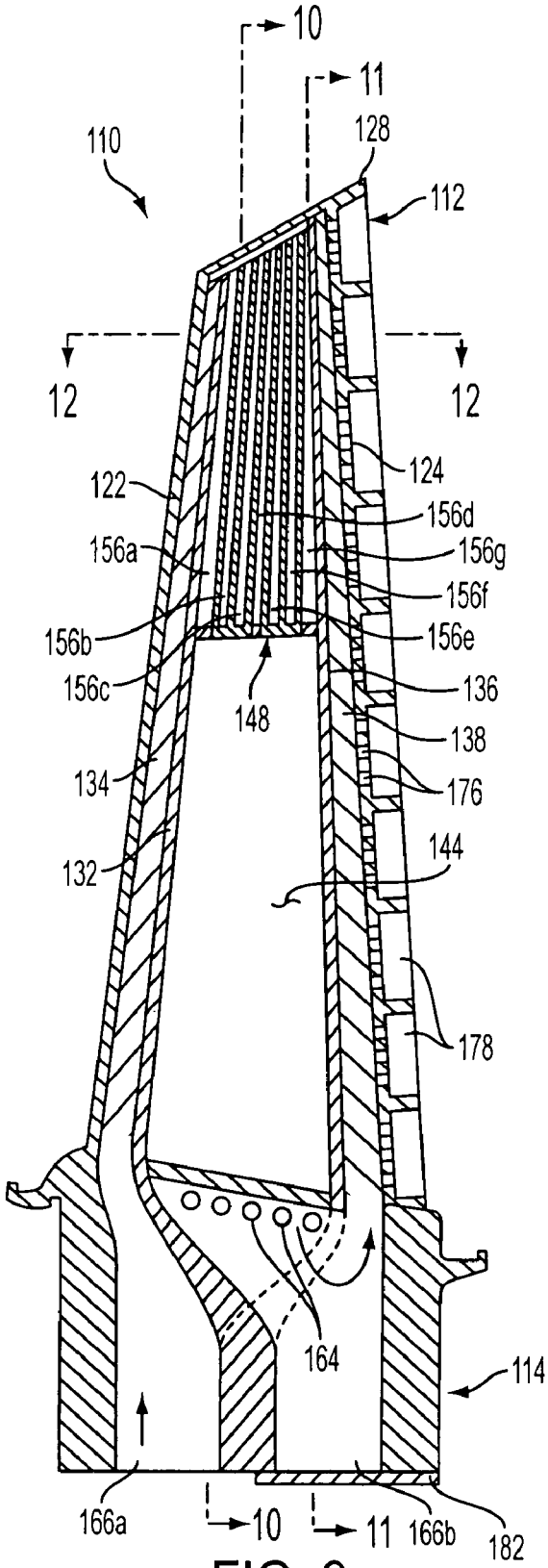
FIG. 9 is a cross-sectional view of an alternative configuration of the turbine blade taken at the location indicated by line 2-2 in FIG. 1.
Figure 10:
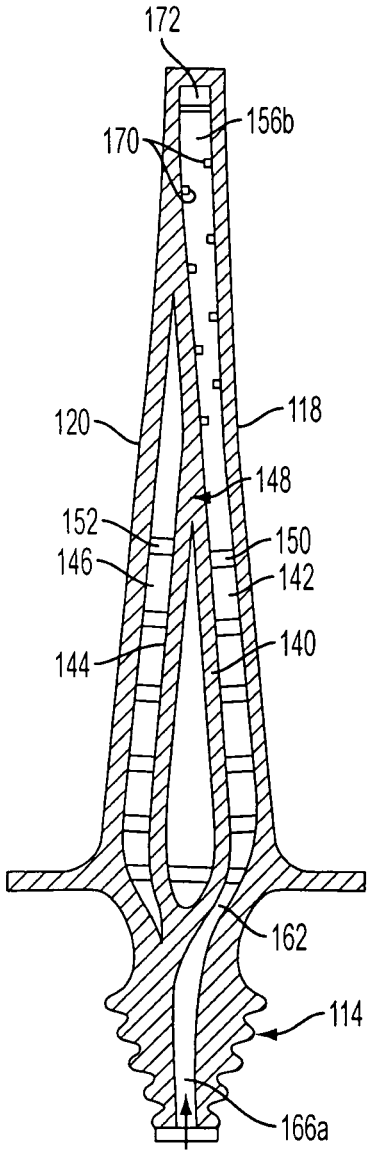
FIG. 10 is a cross-sectional view of the turbine blade shown in FIG. 9 taken along line 10-10.
Figure 11:
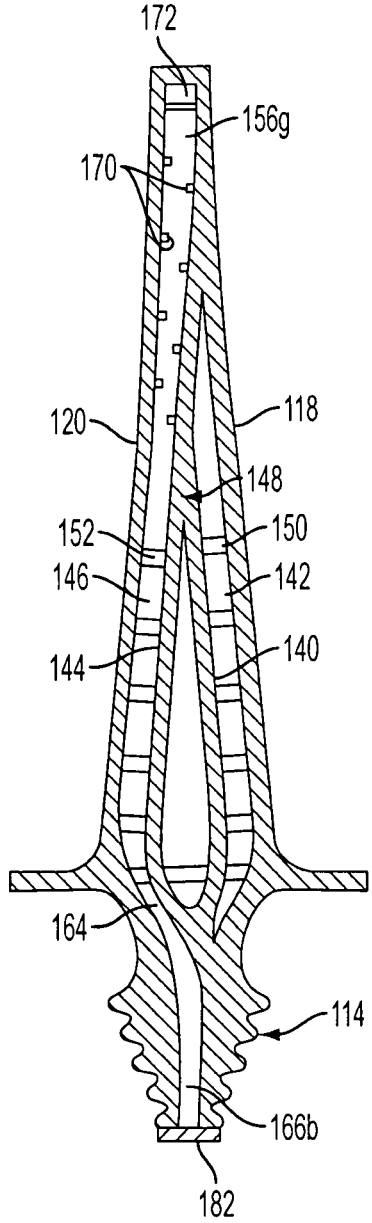
FIG. 11 is a cross-sectional view of the turbine blade shown in FIG. 9 taken along line 11-11.
Figure 12:
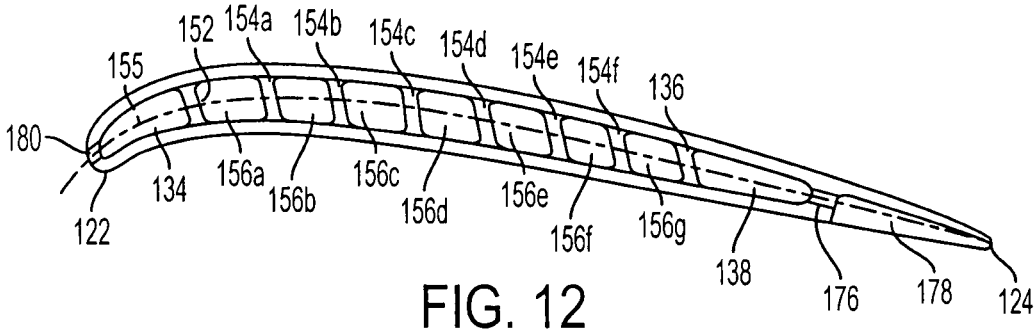
FIG. 12 is a cross-sectional view of the turbine blade airfoil taken at the location indicated by line 12-12 in FIG. 9.

In the present configuration, each of the flow channels 156*a*-156*g* are in direct fluid communication with either the pressure side near wall chamber 142 or the suction side near wall chamber 146. Specifically, each of the flow channels 156*b*, 156*d* and 156*f* extend from the pressure side near wall chamber 142 and comprise a structure, as illustrated for the flow channel 156*b* in FIG. 10; and each of the flow channels 156*a*, 156*c*, 156*e* and 156*g* extend from the suction side near wall chamber 146, as illustrated by the flow channel 156*g* in FIG. 11. The pressure side near wall chamber 142 is connected to a cooling fluid supply opening 166*a* in the blade root 114 by one or more conduits 162. In addition, the blade root 114 includes an opening 166*b* that is covered by a cover plate 182, and the suction side near wall chamber 146 is connected to the opening 166*b* by one or more conduits 164. The opening 166*b* is further open to the trailing edge flow channel 138 (FIG. 9).

A cooling fluid, such as cooling air supplied from the compressor, enters the blade 110 through the supply opening 166*a*, flowing radially outwardly through the leading edge flow channel 134 and through the pressure side near wall chamber 142 and associated flow channels 156*b*, 156*d*, 156*f* to the tip passage 172. From the tip passage 172, the cooling fluid flows radially inwardly through the flow channels 156*a*, 156*c*, 156*e* and 156*g* and through the suction side near wall chamber 146. The cooling fluid then passes through the conduits 164 to the opening 166*b*, and subsequently flows radially outwardly through the trailing edge flow channel 138 and exits the airfoil 112 through exit holes 176 to trailing edge slots 178. Accordingly, the cooling fluid circuit of the configuration described with reference to FIGS. 9-12 provides a triple-pass serpentine path for the cooling fluid.

In both of the above described configurations, the pressure side near wall chamber 42, 142 is not in flow communication with the suction side near wall chamber 46, 146, thus permitting the individual flow chambers to be individually designed based on the external heat load on the pressure sidewall 18, 118 and the suction sidewall 20, 120 of the airfoil 12, 112. In addition, the individual flow channels may be designed with reference to the heat load at particular locations on the airfoil 12, 112. Further, in both configurations of the cooling circuit, the triple-pass configuration comprises an aft flowing fluid path directing the cooling fluid to flow radially through separated mid-chord section near wall cooling paths, defined by the near wall chambers 42, 46 and 142, 146 and associated flow channels 56*a*-*g* and 156*a*-*g*, as it flows to the trailing edge flow channel 38, 138.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade comprising:

an outer wall extending from a blade root to a blade tip, said outer wall comprising a pressure sidewall and a suction sidewall, said pressure and suction sidewalls connected at chordally spaced leading and trailing edges;

a cooling cavity defined between said pressure and suction sidewalls;

a pressure side inner wall extending radially within said cooling cavity from a location adjacent said blade root toward said blade tip and defining a pressure side near wall chamber;

a suction side inner wall extending radially within said cooling cavity from a location adjacent said blade root toward said blade tip and defining a suction side near wall chamber;

said suction side inner wall intersecting said pressure side inner wall at an intermediate location between said blade root and said blade tip;

a plurality of pressure side channels extending radially from said intermediate location to a tip passage at said blade tip for connecting said pressure side near wall chamber in fluid communication with said tip passage; and a plurality of suction side channels extending radially from said intermediate location to said blade tip passage for connecting said suction side near wall chamber in fluid communication with said tip passage.

2. The turbine blade of claim 1, wherein said tip passage connects said pressure side channels in fluid communication with said suction side channels.

3. The turbine blade of claim 2, wherein each of said pressure side channels and said suction side channels are generally positioned along a chordal centerline of said airfoil.

4. The turbine blade of claim 1, including a leading edge flow channel extending radially adjacent to said leading edge, and a trailing edge flow channel extending radially adjacent to said trailing edge wherein said pressure side and suction side near wall chambers are located between said leading edge and trailing edge flow channels.

5. The turbine blade of claim 4, wherein cooling fluid flows radially outwardly through said leading edge flow channel to said tip passage.

6. The turbine blade of claim 5, wherein said cooling fluid flows radially outwardly through said pressure side and suction side near wall chambers and through said pressure side and suction side channels to said tip passage.

7. The turbine blade of claim 6, including a collection cavity defined between said pressure side inner wall and said suction side inner wall, and a plurality of return channels extending between said pressure side channels and said suction side channels and connecting said tip passage to said collection cavity, wherein said cooling fluid flows radially inwardly from tip passage to said collection cavity through said return channels.

8. The turbine blade of claim 7, including a passage adjacent said blade root between said collection cavity and said trailing edge flow channel, and cooling fluid from said collection cavity flows radially outwardly through said trailing edge flow channel.

9. The turbine blade of claim 5, wherein cooling fluid further flows radially outwardly through said pressure side near wall chamber and through said pressure side channels to said tip passage, and said cooling fluid flows radially inwardly from said tip passage through said suction side channels and through said suction side near wall chamber.

10. The turbine blade of claim 9, wherein said cooling fluid flows from said suction side near wall chamber to said trailing edge flow channel, and flows radially outwardly through said trailing edge flow channel.

11. A turbine blade comprising:

an outer wall extending from a blade root to a blade tip, said outer wall comprising a pressure sidewall and a suction sidewall, said pressure and suction sidewalls connected at chordally spaced leading and trailing edges;

a cooling cavity defined between said pressure and suction sidewalls;

a pressure side inner wall extending radially within said cooling cavity from a location adjacent said blade root toward said blade tip and defining a pressure side near wall chamber;

a suction side inner wall extending radially within said cooling cavity from a location adjacent said blade root toward said blade tip and defining a suction side near wall chamber;

a leading edge flow channel extending radially adjacent to said leading edge;

a trailing edge flow channel extending radially adjacent to said trailing edge;

a cooling fluid supply providing cooling fluid to at least said leading edge flow channel, said cooling fluid flowing in at least a triple-pass serpentine path through said leading edge flow channel, said pressure side near wall chamber, said suction side near wall chamber and said trailing edge flow channel;

said pressure side inner wall and said suction side inner wall converge to an intermediate location between said blade root and said blade tip; and including a plurality of mid-chord channels extending radially between said intermediate location and a tip passage at said blade tip.

12. The turbine blade of claim 11, wherein said cooling fluid flows radially outwardly through said leading edge flow channel and through at least said pressure side near wall chamber to said tip passage, and said cooling fluid flows radially inwardly from said tip passage through a plurality of said mid-chord channels.

13. The turbine blade of claim 12, including a collection cavity defined between said pressure side inner wall and said suction side inner wall, and said cooling fluid flows radially outwardly through both said pressure side and suction side near wall chambers and through a plurality of said mid-cord channels to said tip passage, and then flows radially inwardly through a plurality of said mid-chord channels from said tip passage to said collection cavity.

14. The turbine blade of claim 13, wherein said trailing edge flow channel receives said cooling fluid from said collection cavity, and said cooling fluid flows radially outwardly through said trailing edge flow channel.

15. The turbine blade of claim 12, wherein said cooling fluid flows radially inwardly though a plurality of said mid-chord channels from said tip passage to said suction side near wall chamber.

16. The turbine blade of claim 15, wherein said trailing edge flow channel receives said cooling fluid from said suction side near wall chamber, and said cooling fluid flows radially outwardly through said trailing edge flow channel.

* * * * *